United States Patent [19]

Cohen

[11] 4,291,885

[45] Sep. 29, 1981

[54] BALL RECOVERY SYSTEM

[76] Inventor: Robert S. Cohen, 15021 Lemay St., Van Nuys, Calif. 91405

[21] Appl. No.: 72,192

[22] Filed: Sep. 4, 1979

[51] Int. Cl.[3] ..... F41J 1/00; A63B 63/08; A63B 69/00

[52] U.S. Cl. ..... 273/347; 273/1.5 A; 273/397; 273/DIG. 19

[58] Field of Search ..... 273/1.5 R, 1.5 A, 395, 273/396, 397, 394, 344–347, DIG. 19

[56] References Cited

U.S. PATENT DOCUMENTS

| | | | |
|---|---|---|---|
| 735,415 | 8/1903 | Schrödel | 273/347 |
| 1,381,466 | 6/1921 | Jackson, Jr. | 273/1.5 R |
| 2,145,434 | 1/1939 | Rubin | 273/347 |
| 3,109,647 | 11/1963 | Austin | 273/1.5 R |
| 3,233,896 | 2/1966 | King | 273/1.5 A |
| 3,752,477 | 8/1973 | Hoyt | 273/1.5 R |
| 3,901,506 | 8/1975 | Caveney | 273/1.5 A |
| 4,145,044 | 3/1979 | Wilson et al. | 273/1.5 R |

FOREIGN PATENT DOCUMENTS

| | | | |
|---|---|---|---|
| 2321436 | 11/1974 | Fed. Rep. of Germany | 273/1.5 R |
| 306083 | 6/1955 | Switzerland | 273/1.5 R |

*Primary Examiner*—Paul E. Shapiro
*Attorney, Agent, or Firm*—Clifford B. Boehmer

[57] ABSTRACT

A modified basketball game that can be played by a person confined to a bed or a wheelchair. The player throws a reduced size basket ball at or through a basket ball hoop. The ball is returned to the player by a recovery device consisting of a net deployed below the basket ball hoop and backboard at one end and attached to the player at the other end. An alternative embodiment uses adhesive coated balls which are thrown at the backboard and attach themselves to the backboard through a net material. When the net material is forced away from the backboard the balls fall into the recovery device and are returned to the player.

8 Claims, 6 Drawing Figures

FIG. 4
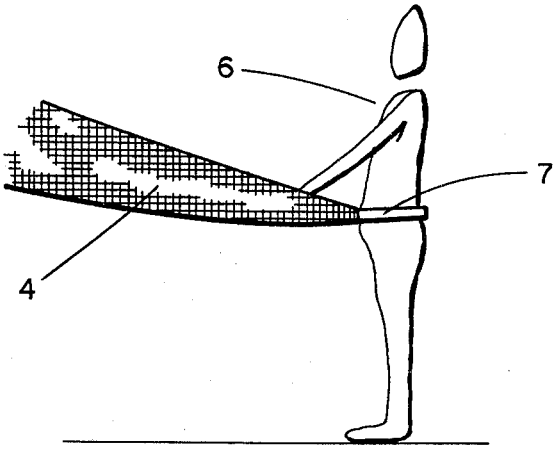
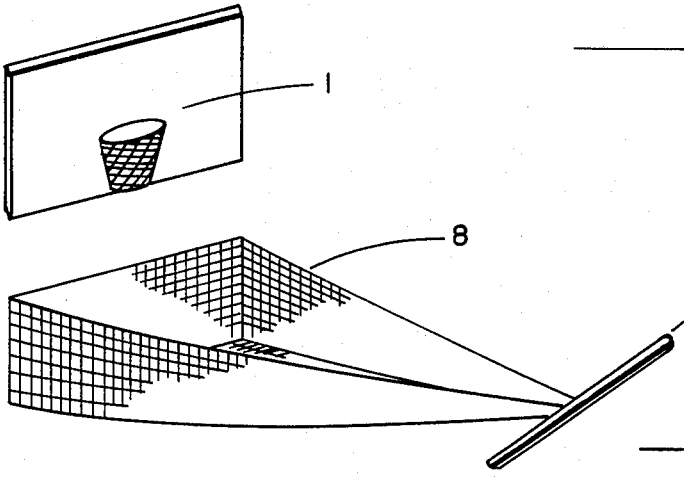
FIG. 5
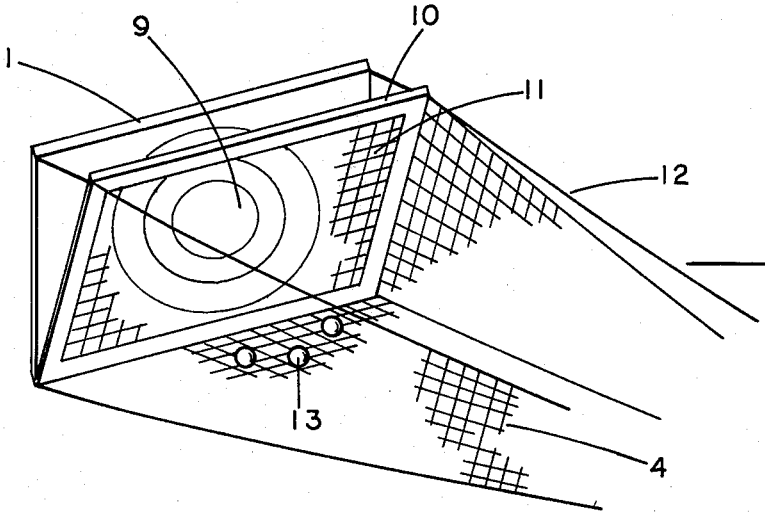
FIG. 6

BALL RECOVERY SYSTEM

BACKGROUND OF THE INVENTION

No effort appears to have been made to provide any suitable means for an immobilized individual to participate alone in games of skill and sport involving thrown projectiles such as darts and balls.

Retrieving said projectiles has always created a problem. Additional persons have been required to retrieve said projectiles, contributing to the immobilized individuals feelings of dependency; possibly the most distressing aspect of immobilization and one that needs no further strengthening.

This invention is a means for immobilized individuals to participate alone in games of skill and sport involving thrown round projectiles, and providing for their return to the individual for repeated use.

Every act the individual performs with this invention creates and/or contributes toward his/her feeling of independence. This helps to improve the individuals state of mind, which many physicians have stated as the single most effective aid toward recovery for a convalescing individual.

This invention also provides additional exercise for the upper extremities in addition to normal therapy.

This invention was developed and tested in a hospital and allows persons confined to a bed or wheelchair to actively engage in games such as basketball.

A search of existing patents did not reveal any devices which could be used in this environment. The field of the search was class 273, subclass 1.5,103.

The following U.S. Pat. Nos. are submitted as being of interest in this invention: 1,769,269, 273/1.5, 2,617,653, 273/1.5, 2,659,495, 273/1.5, 3,233,896, 273/1.5, 3,776,550, 273/1.5, 3,901,506, 273/103.

KING, U.S. Pat. No. 3,233,896 describes a ball return device to be used with a conventional basketball court, the ball must enter the basket or come close to be returned to the player at the foul line. The end of the recovery (Ball return) device is attached to the floor of the court.

CAVENEY, U.S. Pat. No. 3,901,506 describes a similar system except the recovery system allows a greater miss-distance from the basketball hoop. The end of the recovery device is still attached to the floor of the court.

McNABB, U.S. Pat. No. 3,776,550, also describes a similar system except with a wider recovery system allowing a still larger miss-distance. The bottom of the recovery system is still on the floor of a conventional basketball court. This patent also describes a device which throws the returned ball to the player. HATLEY, U.S. Pat. No. 351,635 also describes a ball return system for a conventional basketball court where the end of the recovery system is terminated on the floor of the court.

ELLIOTT, U.S. Pat. No. 2,658,635 describes a toy or miniature table game which employs a ball return device.

KELLER, U.S. Pat. No. 2,617,653, also describes a toy miniature table game which employs a ball return device.

The present invention is dissimilar to all of these, it utilizes a recovery system, but one that is designed for a hospital bed or wheelchair situation. The recovery system of the above patents are all of the rigid type and are terminated on the floor of the basketball court or game.

The recovery system of this invention is non-rigid and is terminated at the waist of the player.

SUMMARY OF THE INVENTION

The present invention presents a means for a person confined to a bed or a wheelchair to play a game which involves throwing or tossing an object toward a basket or target. The preferred embodiment uses a full sized or reduced sized basket ball hoop mounted on a backboard. The backboard is attached to a suitable support structure which includes a hospital intravenous (IV) stand, the end poles of a hospital bed or a door. A net recovery device is attached to the sides and bottom of the backboard at one end and attached to a strap at the other end. The strap is tied around the waist of the player.

The player throws the basket ball toward the basket ball hoop. If the ball goes through the hoop, misses but hits the backboard or falls short of the basket, the ball will fall into the recovery device and will be returned to the player.

An alternative embodiment uses an adhesive coated ball which is thrown at a target mounted on the backboard. A net attached to a frame is placed in front of the target. The adhesive coated balls attach themselves to the target, through the net when they impact the target. The net and frame are then pulled away from the backboard by the player through a flexible line arrangement which causes the balls to fall into the recovery device and return to the player. The net and frame are returned to its originial position against the backboard by a spring-hinge when the line system is released.

BRIEF DESCRIPTION OF THE DRAWINGS

The complete drawing of the preferred embodiment of this invention is shown in

Figure 2:
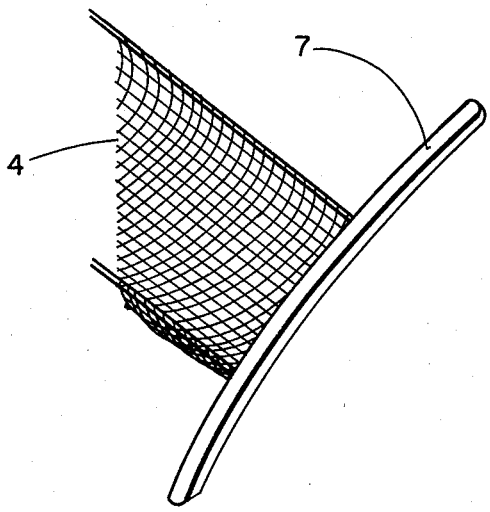

The details of the strap 7, is shown in FIG. 2.

Figure 3:
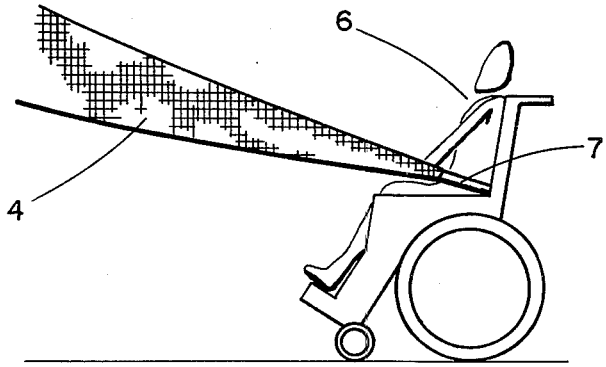

FIGS. 3 and 4 show alternate positions of the player 6.

FIG. 5 shows an alternate embodiment where the recovery device 8, is fabricated to fit the backboard 1.

FIG. 6 shows an alternate embodiment which utilizes a frame 10, and net cover 11, which is pulled away from the backboard 1, by a flexible line device 12. The balls 13, which are thrown at the target 9, are coated with a suitable material which causes them to stick to the backboard 1. When the frame 10, and net cover 11, are pulled from the backboard 1, the balls 13, fall into the recovery device 4.

DESCRIPTION OF THE PREFERRED EMBODIMENTS

Figure 1:
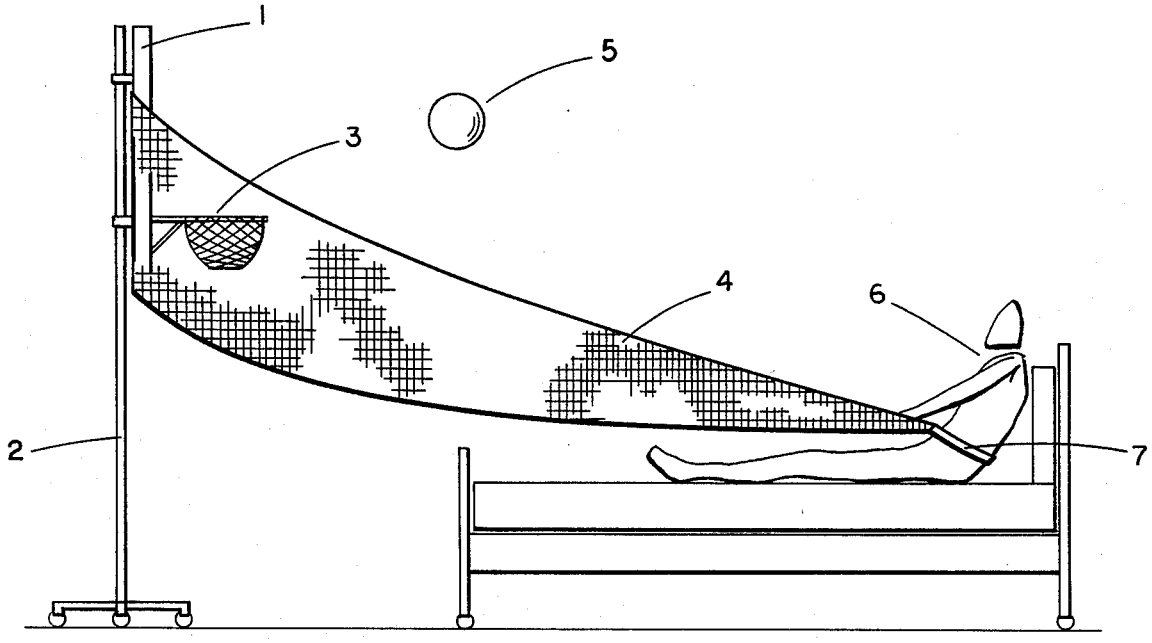
FIG. 1 where the backboard 1, is shown attached to a suitable support structure 2, with the basketball hoop 3, attached to it. The recovery device 4, is shown attached to the backboard 1, and to the player 6, by the strap 7.

Referring to the drawings, more particularly by reference numbers, number 1 in FIG. 1 refers to a backboard of suitable material which can be attached to a number of support structures. In FIG. 1, the backboard 1 is attached, in an easily removable manner, to a standard intravenous (IV) stand 2. The backboard can also be attached, with suitable means, to a standard door, the end poles of a standard hospital bed or a wall or a other suitable support structures. A reduced size basketball hoop with net 3 is attached to the backboard 1. A ball recovery system 4, composed of a net material, is attached by suitable detachable means to the sides, face, and bottom of the backboard 1 to form a open top though container in which a thrown ball 5 will fall after having passed through the basketball hoop 3 or having hit the backboard 1. The ball 5 is a full size or reduced sized basketball of suitable material. The basketball 5 falls into the recovery system 4 and is propelled by gravity down to the player 6. A stray 7, in FIG. 2, is attached by suitable means to the end of the recovery system 4. The strap 7, can be secured around the waist of the player 6 while the player 6 is sitting or lying in a bed, sitting in a wheelchair, or standard chair, as in FIG. 3, or standing as in FIG. 4. The strap 7, can also be attached to any fixed object as a bed rail or desk in lieu of the player.

Another alternate embodiment of the subject invention is shown in FIG. 6. In this embodiment, a target 9, is mounted on the backboard 1. The player 6 throws balls, 13 which are coated with a suitable adhesive material, at target 9, which attach themselves to the backboard 1 when they impact the backboard 1. A frame 10, is attached to the bottom of the backboard 1, by a suitable spring actuated hinge 15, and is attached to the top of backboard 1, by an elastic material 14, which allows the frame to be pulled away from the backboard 1 by a line 12. The frame 10 will return to the position lying against backboard 1 when the tension on the line 12 is released. A net material 11 is attached to the frame 10 so as to cover the front of the backboard.

The adhesive coated balls 13 will attach themselves to the backboard 1 thru the net material 11. When line 12 is pulled, the frame 10 and net material 11 will be pulled away from backboard 1 and force the balls 13 to disattach themselves from the backboard 1 and fall to the recovery system 4 and then returned by gravity to player 6.

What is claimed is:

1. A recreational device, comprising:

(a) A backboard;

(b) A frame connected to the said backboard on the lower edge with a hinge device and resting flush with the said backboard;

(c) A screen connected within said frame;

(d) A flexible line connected to the top of said frame;

(e) An open top trough recovery device connected to said backboard;

(f) A strap connected to said recovery device;

(g) A set of adhesive coated balls.

2. A recreational device, as recited in claim 1, wherein said screen connected to said frame is composed of a wire mesh.

3. Recreational device, as recited in claim 1, wherein said screen connected to said frame is composed of a net fabric.

4. A recreational device as recited in claim 1, wherein said strap is configured to be secured to any suitable object.

5. A recreational device as recited in claim 1, wherein said recovery device is composed of a suitable cloth material connected to said backboard in a suitable manner.

6. A recreational device as recited in claim 1, wherein said recovery device is composed of a net material connected to said backboard in a suitable manner.

7. A recreational device as recited in claim 1, wherein said recovery device is composed of a suitable material shaped to fit said backboard and attached to said backboard in a removable manner.

8. A recreational device as recited in claim 1, wherein said backboard is provided with suitable means to attach said backboard to any suitable support structure.

* * * * *